US010527994B2

(12) United States Patent
Aoki

(10) Patent No.: US 10,527,994 B2
(45) Date of Patent: Jan. 7, 2020

(54) CLEANING APPARATUS AND IMAGE FORMING APPARATUS

(71) Applicant: Konica Minolta, Inc., Chiyoda-ku, Tokyo (JP)

(72) Inventor: Yoshikazu Aoki, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/397,911

(22) Filed: Apr. 29, 2019

(65) Prior Publication Data

US 2019/0354053 A1 Nov. 21, 2019

(30) Foreign Application Priority Data

May 16, 2018 (JP) ..... 2018-094533

(51) Int. Cl.
*G03G 15/00* (2006.01)
*G03G 21/00* (2006.01)

(52) U.S. Cl.
CPC ..... *G03G 15/55* (2013.01); *G03G 21/0011* (2013.01)

(58) Field of Classification Search
CPC . G03G 21/0011; G03G 21/0029; G03G 15/55
See application file for complete search history.

(56) References Cited

U.S. PATENT DOCUMENTS 4,465,362 A * 8/1984 Tohma ..... G03G 21/0029 101/169
2013/0195485 A1* 8/2013 Ueno ..... G03G 15/161 399/53
2016/0223979 A1* 8/2016 Fukushima ..... G03G 21/1828

FOREIGN PATENT DOCUMENTS

JP 2010-231057 A 10/2010

* cited by examiner

*Primary Examiner* — Gregory H Curran
(74) *Attorney, Agent, or Firm* — Squire Patton Boggs (US) LLP

(57) ABSTRACT

A cleaning apparatus includes a cleaning unit, a leaf spring, a holding member, and a strain detection unit. The cleaning unit is configured to contact a surface of an image carrier. The leaf spring supports the cleaning unit. The holding member holds the leaf spring. At least one strain detection unit is attached to the leaf spring. The strain detection unit is configured to detect strain of the leaf spring due to deformation of the leaf spring. The leaf spring has a first end and a second end. The leaf spring includes, at the first end, a first joint region to which the cleaning unit s joined and includes, at the second end, a second joint region to which the holding member is joined. The strain detection unit is located between the first joint region and the second joint region.

14 Claims, 14 Drawing Sheets

CLEANING APPARATUS AND IMAGE FORMING APPARATUS

The entire disclosure of Japanese Patent Application No. 2018-094533, filed on May 16, 2018, is incorporated herein by reference in its entirety.

BACKGROUND

Technological Field

The present invention relates to a cleaning apparatus and an image forming apparatus.

Description of the Related Art

A cleaning apparatus having a blade is generally a periodic replacement part. In most cases, the replacement cycle is determined based on the running distance for which the blade has run. The replacement cycle, however, is determined to have some allowance, and therefore, the blade is mostly replaced before the lifetime of the cleaning apparatus expires. The cleaning apparatus is one of short-lifetime parts in an image forming apparatus. There has been a demand for a technology for using the cleaning apparatus until its lifetime expires, in order to reduce the cost for periodic replacement and ensure a high productivity.

Japanese Laid-Open Patent Publication No. 2010-231057 discloses a technology for determining the lifetime of a cleaning apparatus by detecting strain of a blade with a strain gauge attached to a surface of the blade and comparing the strain with a threshold value. The cleaning apparatus disclosed in above-referenced Japanese Laid-Open Patent Publication No. 2010-231057 includes the blade to be brought into contact with art image carrier, a support plate supporting the blade, and a strain gauge (strain detection means). The strain gauge is disposed on a surface of the blade such that the strain gauge extends across the joint between the blade and the support plate.

SUMMARY

When the blade is brought into contact with the image carrier, the blade is flexed entirely, while the joint between the blade and the support plate is less prone to be flexed. In the cleaning apparatus disclosed in Japanese Laid-Open Patent Publication No. 2010-231057, the strain gauge is disposed to extend across the joint between the blade and the support plate, which may result in a smaller value of the detected strain and deterioration of the strain detection accuracy.

An object of the present invention is to provide a cleaning apparatus and an image forming apparatus that can improve the strain detection accuracy.

To achieve at least one of the abovementioned objects, according to an aspect of the present invention, a cleaning apparatus reflecting one aspect of the present invention is configured to clean a surface of an image carrier. The cleaning apparatus includes a cleaning unit, a leaf spring, a holding member, and at least one strain detection unit. The cleaning unit is configured to contact the surface of the image carrier. The leaf spring supports the cleaning unit. The holding member holds the leaf spring. The strain detection unit is attached to the leaf spring. The strain detection unit is configured to detect strain of the leaf spring due to deformation of the leaf spring. The leaf spring has a first end and a second end. The leaf spring includes, at the first end, a first joint region to which the cleaning unit is joined and includes, at the second end, a second joint region to which the holding member is joined. The strain detection unit is located, between the first joint region and the second joint region.

To achieve at least one of the abovementioned objects, according to an aspect of the present invention, an image forming apparatus reflecting one aspect of the present invention comprises the cleaning apparatus; a developing device configured to supply a developer to the image carrier; and a controller configured to control the developing device to cause the developing device to supply the developer to the image carrier when a result of detection by the strain detection unit reaches a first threshold value.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
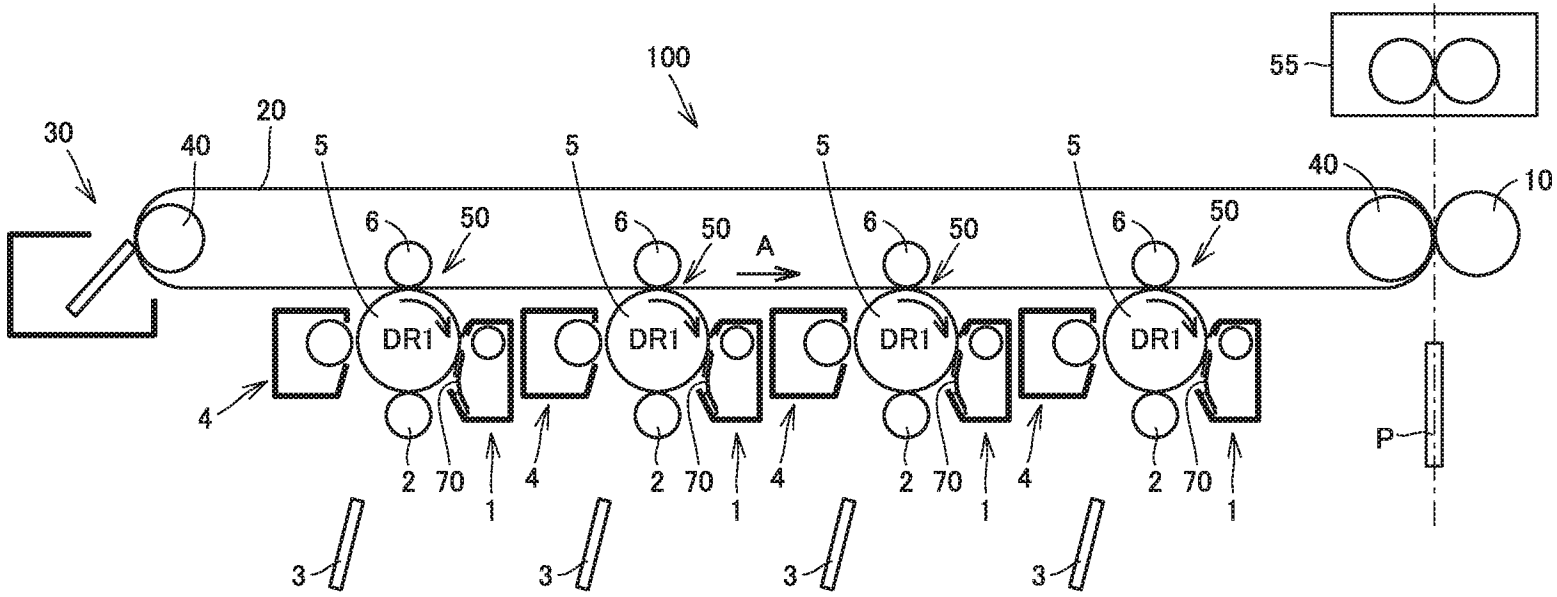
FIG. 1 is a schematic diagram of an image forming apparatus in a first embodiment.

Hereinafter, one or more embodiments of the present invention will be described with reference to the drawings. However, the scope of the invention is not limited to the disclosed embodiments.

In the embodiments below, an image forming apparatus is described by illustrating, by way of example, a so-called tandem color printer to which electrophotography is applied, and the image forming apparatus included in the color printer. In the following embodiments, the same or common parts are denoted by the same reference characters in the drawings, and a description thereof is not repeated.

First Embodiment

<Image Forming Apparatus 100>

FIG. 1 is a schematic diagram of an image forming apparatus 100 in a first embodiment. Referring to FIG. 1, a general configuration and operation of image forming apparatus 100 in the embodiments is described.

Image forming apparatus 100 includes an intermediate transfer belt 20 and a plurality of support rollers 40. Intermediate transfer belt 20 is supported by support rollers 40 arranged in parallel with each other, with a constant belt tension applied from support rollers 40 to intermediate transfer belt 20. A machine body is operably coupled to one of a plurality of support rollers 40. As support rollers 40 rotate, intermediate transfer belt 20 rotates (in direction A in FIG. 1).

Image forming apparatus 100 includes a plurality of image forming units 50. Image forming units 50 each include an image carrier 5, a charging unit 2, an exposure unit 3, a developing device 4, a primary transfer roller 6, and a cleaning apparatus 1.

Charging unit 2, exposure unit 3, developing device 4, primary transfer roller 6, and cleaning apparatus 1 are arranged in this order around image carrier 5. Charging unit 2 uniformly charges the surface of image carrier 5. Exposure unit 3 exposes the surface of image carrier 5 to light. Accordingly, an electrostatic latent image is formed on the surface of image carrier 5. Developing device 4 supplies a developer (toner) to the surface of image carrier 5 on which the electrostatic latent image is formed. A toner image is thus formed on the surface of image carrier 5. Primary transfer roller 6 transfers the toner image formed on the surface of image carrier 5 onto intermediate transfer belt 20, using the action of an electric field force (primary transfer). Cleaning apparatus 1 removes toner remaining on the surface of image carrier 5 after the primary transfer (hereinafter referred to as post-transfer residual toner).

Image forming apparatus 100 also includes a secondary transfer roller 10 and a fixing unit 55. Secondary transfer roller 10 is disposed downstream of primary transfer rollers 6 of respective colors, with respect to the direction in which intermediate transfer bell 20 rotates. Secondary transfer roller 10 transfers toner images of multiple colors transferred and laid on each other on intermediate transfer belt 20, to a recording medium P using the action of an electric field force (secondary transfer). The loner image transferred onto recording medium P by the action of secondary transfer roller 10 is heated and pressurized by fixing unit 55 to be fixed to recording medium P.

Image forming apparatus 100 further includes belt cleaning means 30. Belt cleaning means 30 cleans and removes toner remaining on intermediate transfer belt 20, from the surface of intermediate transfer belt 20.

For image forming units 50, intermediate transfer belt 20. belt cleaning means 30, secondary transfer roller 10, and fixing unit 55 for example that are used for image forming apparatus 100, optionally the well-known electrophotography may be selected.

Cleaning Apparatus 1

Figure 2:
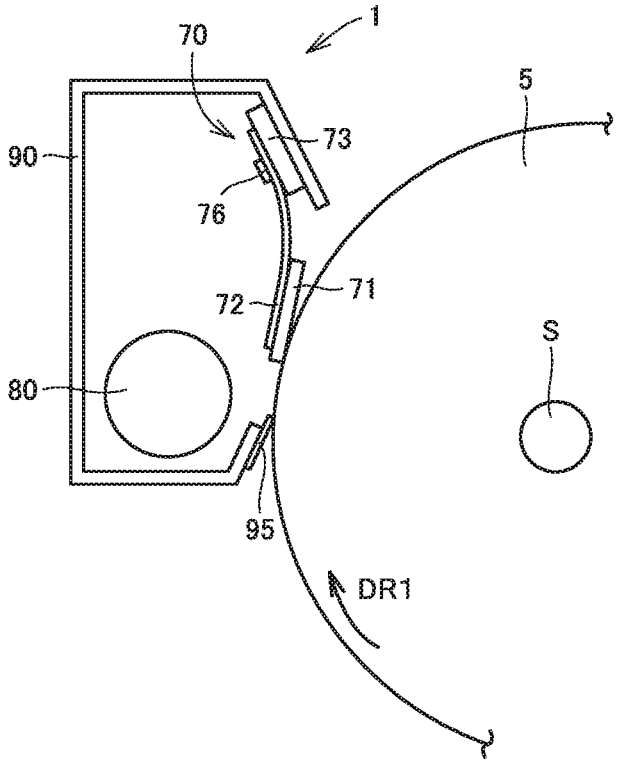
FIG. 2 is a schematic diagram of a cleaning apparatus in the first embodiment.

FIG. 2 is a schematic diagram of cleaning apparatus I in the first embodiment. The arrow shown in FIG. 2 indicates rotational direction DR1. Rotational direction DR1 is the direction in which image carrier 5 is rotated and this direction is the clockwise direction in FIG. 2. Image carrier 5 has a rotational shaft S. Image carrier 5 rotates about rotational shaft S.

Cleaning apparatus 1 cleans the surface of image carrier 5. Cleaning apparatus 1 includes a blade unit 70, a transport screw 80, a housing 90, and a seal member 95.

Blade unit 70 scrapes a developer or the like adhering to the surface of image carrier 5 to clean image carrier 5. Blade unit 70 is disposed in housing 90. Blade unit 70 includes a cleaning unit 71, a leaf spring 72 made of a metal material, and a holding member 73. Cleaning unit 71 is configured to contact the surface of image carrier 5. Leaf spring 72 supports cleaning unit 71. Holding member 73 holds leaf spring 72. Details of blade unit 70 are described later herein.

Depending on the position and the angle at which holding member 73 is disposed in housing 90, the distance between image carrier 5 and cleaning unit 71 is determined. As this distance is determined, the free length of leaf spring 72 and the amount of flexure of leaf spring 72 are determined.

As cleaning unit 71 is brought into contact with image carrier 5, leaf spring 72 is flexed. Accordingly, cleaning unit 71 is kept in contact with image carrier 5 with a predetermined pressure. Since cleaning unit 71 is kept in contact with image carrier 5 with a predetermined pressure, cleaning unit 71 can scrape the post-transfer residual toner.

Housing 90 is disposed to face image carrier 5. Housing 90 contains the post-transfer residual toner scraped by cleaning unit 71. Seal member 95 is attached to housing 90. Seal member 95 is located upstream of cleaning unit 71 with respect to rotational direction DR1. Seal member 95 is disposed so as to prevent the post-transfer residual toner from scattering to the outside of housing 90.

Transport screw 80 is disposed in housing 90. Transport screw 80 transports the removed post-transfer residual toner to a waste toner box (not shown).

Blade Unit 70

Figure 3:
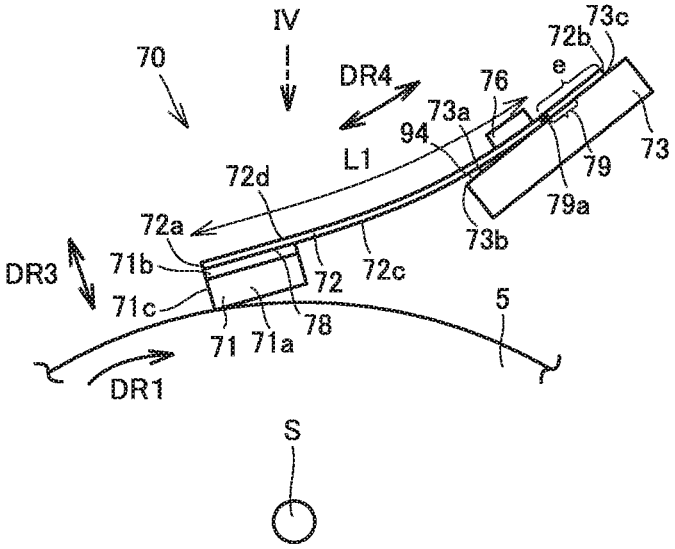
FIG. 3 is a schematic diagram of a blade unit in the first embodiment.
Figure 4:
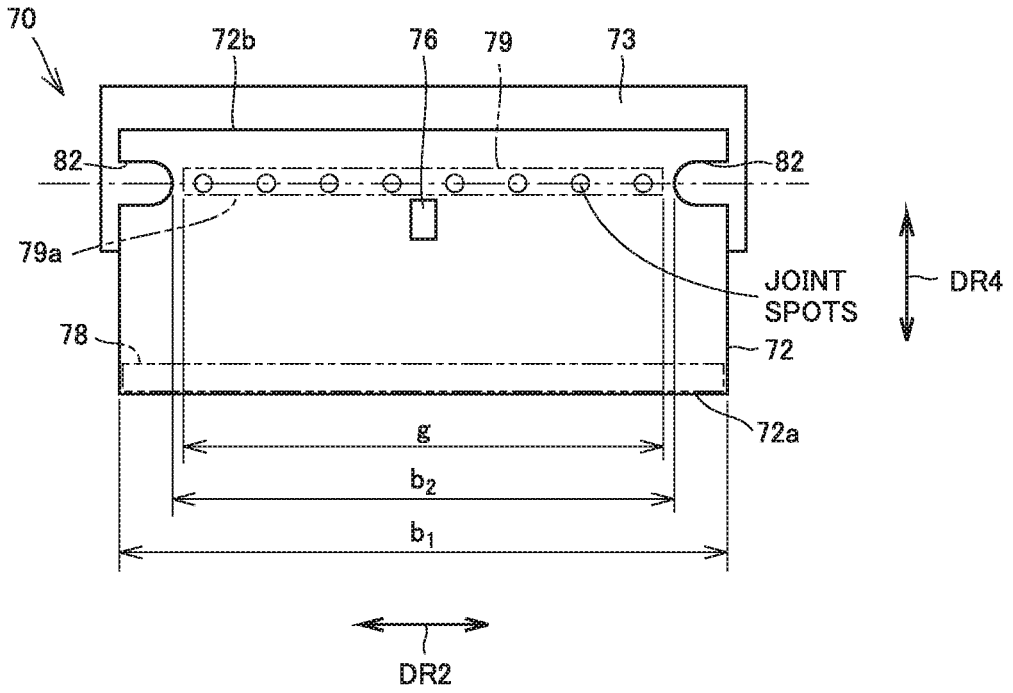
FIG. 4 is a schematic plan view of the blade unit shown in FIG. 3 as seen in direction IV.

FIG. 3 is a schematic diagram of blade unit 70 in the first embodiment. FIG. 4 is a schematic plan view of blade unit 70 shown in FIG. 3, as seen in direction IV. Referring to FIGS. 3 and 4, details of blade unit 70 are described.

The double-headed arrows shown in FIGS. 3 and 4 represent axial direction DR2, thickness direction DR3, and shorter-dimension direction DR4. Axial direction DR2 is the axial direction of rotational shaft S and is the left-to-right direction in FIG. 4. Thickness direction DR3 is the thickness direction of leaf spring 72. Shorter-dimension direction) DR4 is the direction in which leaf spring 72 extends as seen in axial direction DR2, and is the top-to-bottom direction in FIG. 4.

Blade unit 70 (cleaning unit 71, leaf spring 72, and holding member 73) is shaped to extend in axial direction DR2. The material for leaf spring 72 is preferably stainless steel, phosphor bronze, or the like having high corrosion resistance, and particularly preferably stainless steel having a high strength and less fatigue. Preferably, leaf spring 72 has a Young's modulus of not less than 98 [GPa] and not more than 206 [GPa].

Preferably, the length of leaf spring 72 in shorter-dimension direction DR4 is approximately not less than 10 [mm] and not more than 20 [mm]. Preferably, the thickness of leaf spring 72 in thickness direction DR3 is approximately not less than 0.05 [mm] and not more than 0.1 [mm], in order to ensure that leaf spring 72 conforms sufficiently to image carrier 5.

As shown in FIG. 4, at the position where a second joint region 79 which is described later herein is located, the length (b2 in FIG. 4) of leaf spring 72 in axial direction DR2 is shorter than the length (b1 in FIG. 4) of leaf spring 72 in axial direction DR2 at the position where a first joint region 78 which is described later herein is located.

At the position where second joint region 79 is located, leaf spring 72 has notches 82 at respective ends opposite to each other in axial direction DR2. Notches 82 are each formed in a semi-oval shape. The stress concentration can be alleviated in this way.

In leaf spring 72, an image formation region is defined (g in FIG. 4). The image formation region is a region that faces a portion of the surface of image carrier 5 where a toner image is to be formed. Notches 82 are formed outside the image formation region in axial direction DR2. Influences on the image quality can thus be suppressed.

As shown in FIG. 3, leaf spring 72 has a first surface 72*c* and a second surface 72*d*. First surface 72*c* is a surface oriented toward image carrier 5. First surface 72*c* faces image carrier 5. Second surface 72*d* is a surface located opposite to first surface 72*c*.

Leaf spring 72 has a first end 72*a* and a second end 72*b*. Of the ends of leaf spring 72 in shorter-dimension direction DR4, first end 72*a* is an end located closer to image carrier 5 (cleaning unit 71). Of the ends of leaf spring 72 in shorter-dimension direction DR4, second end 72*b* is an end located further from image carrier 5 (cleaning unit 71). At first end 72*a*, leaf spring 72 supports cleaning unit 71.

As cleaning unit 71 is brought into contact with image carrier 5, elastic deformation of leaf spring 72 occurs. First end 72*a* of leaf spring 72 is curved away from image carrier 5. Leaf spring 72 is used under a stress in a range that causes elastic deformation of leaf spring 72 is.

Leaf spring 72 has first joint region 78. First joint region 78 is located at first end 72*a* of leaf spring 72. First joint region 78 is a region extending in axial direction DR2. First joint region 78 faces cleaning unit 71. First joint region 78 is a region to which cleaning unit 71 is joined.

The material for cleaning unit 71 may be any of urethane rubber, fluoro rubber (FKM), styrene butadiene rubber (SBR), and acrylonitrile rubber (NBR), for example. As the material for cleaning unit 71, a material having high wear resistance and high ozone resistance is used.

Cleaning unit 71 has a cleaning end 71*c*. Of the ends of cleaning unit 71 in shorter-dimension, direction DR4, cleaning end 71*c* is the end located closer to first end 72*a*. Cleaning end 71*c* and first end 72*a* are coplanar.

Alternatively, first end 72*a* of leaf spring 72 may protrude relative to cleaning end 71*c* of cleaning unit 71. In this case, first end 72*a* is designed so as not to collide with image carrier 5.

Alternatively, cleaning end 71*c* may protrude relative to first end 72*a*. If the amount of protrusion of cleaning end 71*c* is excessive, only the protruded portion of cleaning unit 71 is deformed excessively, which may result in reduction of the contact pressure between image carrier 5 and cleaning unit 71 due to change with time. The amount of protrusion may therefore be approximately up to 0.5 [mm].

Cleaning unit 71 includes an elastic portion 71*a* made of an elastic material and a joint member 71*b*. Elastic portion 71*a* is configured to contact the surface of image carrier 5. Preferably, the thickness of elastic portion 71*a* in thickness direction DR3 is set approximately to not less than 0.5 [mm] and not more than 2.0 [mm]. Preferably, the length of elastic portion 71*a* in shorter-dimension direction DR4 is approximately not less than 5 [mm] and not more than 10 [mm].

Elastic portion 71*a* is joined to first surface 72*c* of leaf spring 72 by joint member 71*b*. Joint member 71*b* is made for example from a thermoplastic hot-melt adhesive, for example. Joint member 71*b* may be a double-sided adhesive tape, for example. In the first embodiment, the length of joint member 71*b* (elastic portion 71*a*) in shorter-dimension direction DR4 is equal to the length of first joint region 78 in shorter-dimension direction DR4.

Although metal leaf spring 72 and cleaning unit 71 of blade unit 70 in the first embodiment are joined to each other, leaf spring 72 and cleaning unit 71 may be formed as a single unit by integral molding using a die. In this case, cleaning unit 71 does not have joint member 71*b*.

At second end 72*b* of leaf spring 72, holding member 73 is disposed. Holding member 73 is joined to first surface 72*c*. The material for holding member 73 is a steel sheet such as SECC. Preferably, the thickness of holding member 73 in thickness direction DR3 is set to not less than 1.6 [mm] and not more than 2.0 [mm]. In this way, deformation of holding member 73 due to a pressure and an external force for example applied to leaf spring 72 can be suppressed. Accordingly, a predetermined edge straightness of cleaning unit 71 can be ensured.

Holding member 73 includes a facing surface 73*a*. At second end 72*b* of leaf spring 72, facing surface 73*a* faces leaf spring 72 in thickness direction DR3. Facing surface 73*a* has a first end 73*b* and a second end 73*c*.

First end 73*b* is located at a side of cleaning unit 71 in shorter-dimension direction DR4. Of the ends of facing surface 73*a* in shorter-dimension direction DR4, first end 73*b* is closer to cleaning unit 71. Second end 73*c* is located opposite to first end 73*b* in shorter-dimension direction DR4. Of the ends of facing surface 73*a* in shorter-dimension direction DR4, second end 73*c* is located further from cleaning unit 71.

Second Joint Region 79

Leaf spring 72 has second joint region 79. Second joint region 79 is located at second end 72*b* of leaf spring 72. Second joint region 79 is a region extending in axial direction DR2, Second joint region 79 faces facing surface 73*a* of holding member 73. Second joint region 79 is a region of leaf spring 72 to which holding member 73 is joined.

Leaf spring 72 and holding member 73 may be joined together by spot welding, for example. Alternatively, they may be joined together with screw(s) or an adhesive, for example.

In the case where leaf spring 72 and holding member 73 are joined together at points like spot welding or the like, the intervals between the joint spots (see FIG. 4) in axial direction DR2 are preferably not less than 2 [mm] and not more than 20 [mm]. If the intervals are greater than 20 [mm], the contact pressure between respective non-joined portions of elastic portion 71*a* and image carrier 5 is lower, and thus the contact pressure between elastic portion 71*a* and image carrier 5 is nonuniform in axial direction DR2. If the intervals are smaller than 2 [mm], leaf spring 72 may be deformed in a wavy shape.

In the case where leaf spring 72 and holding member 73 are joined together with an adhesive or the like, the adhesive may be applied at intervals that are set similarly to the above-described intervals (not less than 2 [mm] and not more than 20 [mm]), or the adhesive may be applied entirely in axial direction DR2 for joining them together.

In the first embodiment, at a position located closer to second end 73*c* than to first end 73*b*, leaf spring 72 is joined to facing surface 73*a*. Leaf spring 72 is joined at a position located away from first end 73*b* toward second end 73*c*. Accordingly, when elastic portion 71*a* is brought into contact with image carrier 5, a gap 94 is formed at first end 73*b* between first surface 72*c* of leaf spring 72 and facing surface 73*a* of holding member 73. If they are joined together by spot welding, the length of gap 94 in shorter-dimension direction DR4 is preferably not less than 1.5 [mm].

Second joint region 79 has a joint end 79*a*. Of the ends of second joint region 79, joint end 79*a* is the end located further from second end 72*b*. FIG. 3 shows joint end 79*a* as a solid black dot so that joint end 79*a* can be recognized easily (the same applies to the following drawings). The region (e in FIG. 3) of leaf spring 72 extending from joint end 79*a* to second end 72*b* in shorter-dimension direction DR4 is in contact with holding member 73 without being flexed or inclined.

The length from first end 72*a* to joint end 79*a* in shorter-dimension direction DR4 is defined as free length L1 of leaf spring 72. In the first embodiment, when cleaning unit 71 is brought into contact with image carrier 5, leaf spring 72 is flexed away from holding member 73 (image carrier 5), within the range of free length L1 of leaf spring 72.

Strain Gauge 76

One strain detection unit is attached to leaf spring 72. The strain detection unit is a metal foil strain gauge 76. Strain gauge 76 detects strain of leaf spring 72 generated due to deformation of leaf spring 72. Strain gauge 76 detects flexure of leaf spring 72 as the strain. Strain gauge 76 is attached to second surface 72*d*.

An adhesive used for bonding strain gauge 76 to second surface 72*d* is preferably cyanoacrylate-based cold-setting instantaneous adhesive. Alternatively, an insulator may be vapor-deposited or applied onto second surface 72*d* and then strain gauge 76 may be formed by vapor deposition on the insulator.

Strain gauge 76 is disposed between first joint region 78 and second joint region 79 in shorter-dimension direction DR4. Strain gauge 76 is disposed in a region of leaf spring 72 that is located between first joint region 78 and second joint region 79.

Strain gauge 76 is disposed at a position closer to second joint region 79 than to first joint region 78. The length from strain gauge 76 to first joint region 78 in shorter-dimension direction DR4 is larger than the length from strain gauge 76 to second joint region 79 in shorter-dimension direction DR4.

Strain gauge 76 is located on the first end 72*a* side with respect to second joint region 79. Strain gauge 76 is disposed in proximity to second joint region 79 (joint end 79*a*). "In proximity to joint end 79*a* (second joint region 79)" herein indicates the region of leaf spring 72 extending, in shorter-dimension direction DR4, from joint end 79*a* to a portion of leaf spring 72 that faces first end 73*b*.

Figure 5:
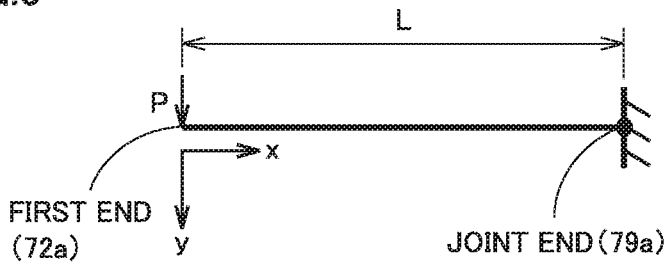
FIG. 5 is a schematic diagram of a leaf spring shown in FIG. 3 approximated to a cantilever.

FIG. 5 is a schematic diagram of leaf spring 72 shown in FIG. 3 approximated to a cantilever. Leaf spring 72 shown in FIG. 3 can be substantially approximated to a cantilever of which joint end 79*a* is a fixed end and first end 72*a* is a free end.

Flexure y of the cantilever at a predetermined position (flexure y of leaf spring 72 at x position) can be represented by Equation (1) below, where L is the length from first end 72*a* to joint end 79*a* in shorter-dimension direction DR2 (free length of leaf spring 72), P is the contact pressure between cleaning unit 71 and image carrier 5, E is the longitudinal elastic modulus of leaf spring 72, I is the second moment of area of leaf spring 72, and x is the distance from first end 72*a*.

$$y=(PL^{\wedge 3}/3EI)\times\{1-(3x/2L)+(x^{\wedge 3}/2L^{\wedge 3})\} \quad (1)$$

Meanwhile, strain y" determined by second order differential of flexure y can be represented by Equation (2) below.

$$y''=(P/EI)\times x \quad (2)$$

It is seen from Equation (2) that the strain value of leaf spring 72 is proportional to distance x from first end 72*a*, and reaches the maximum ((P/EI)×L) at joint end 79*a* (x=L). It is thus seen that the output value of strain gauge 76 is a larger value in the case where strain gauge 76 is attached in proximity to joint end 79*a*.

Controller 60

Figure 6:
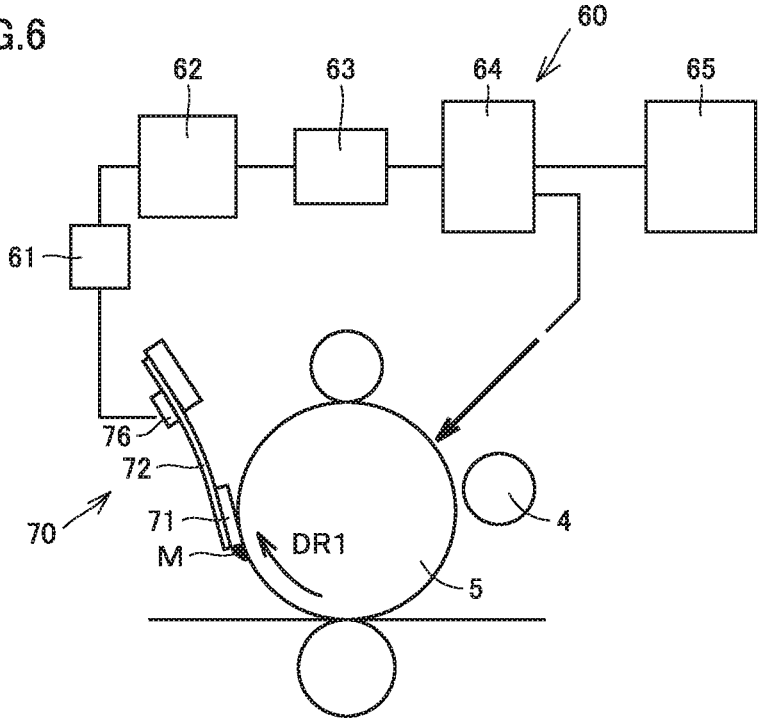
FIG. 6 is a schematic diagram showing a method for controlling the cleaning apparatus in the first embodiment.

FIG. 6 is a schematic diagram showing a method for controlling cleaning apparatus 1 in the first embodiment. Image forming apparatus 100 further includes a controller 60 and a display 65. Controller 60 includes an amplifier 61, a storage unit 62, a calculation unit 63, and a determination unit 64.

Strain gauge 76 detects strain of leaf spring 72 to acquire data on the strain value. It is preferable that the data on the strain value is acquired a larger number of times. The intervals at which the data is acquired may not necessarily be regular intervals. It is preferable that the intervals are larger during an initial stage of rotation of image carrier 5 in which variation of the strain is large and the intervals decrease as blade unit 70 approaches the end of its predicted lifetime.

While image carrier 5 is driven, the frictional force between cleaning unit 71 and image carrier 5 influences the detection of strain. It is therefore preferable that strain gauge 76 detects the strain of leaf spring 72 while rotation of image carrier 5 is stopped.

Image carrier 5 has a deviation clue to its eccentricity. It is therefore preferable to divide the perimeter of image carrier 5 at positions and calculate the average value of respective strain values taken at these positions. In the case where the average value of the strain values is calculated, it is more preferable to measure the strain value at least at eight positions or more.

The contact pressure is applied all the time from image carrier 5 to cleaning unit 71, and therefore, cleaning unit 71 undergoes permanent deformation with time (cleaning unit 71 deteriorates). With the permanent deformation of cleaning unit 71, the strain of leaf spring 72 decreases. Strain gauge 76 detects the decreased strain.

The circuit shown in FIG. 6 is a Wheatstone bridge for amplifying a detection signal of strain gauge 76. Amplifier 61 is connected to strain gauge 76. Amplifier 61 amplifies the value of strain detected by strain gauge 76. Amplifier 61 transmits the amplified value of strain to storage unit 62.

Storage unit 62 successively stores, on a hard disc, a semiconductor memory, or the like, the running distance of blade unit 70 (cleaning apparatus 1), and the history of output values of the strain from amplifier 61. The running distance of blade unit 70 is the amount of rotation of image carrier 5 while cleaning unit 71 and image carrier 5 are kept in contact with each other. The running distance of blade unit 70 is represented by the product of the diameter of image carrier 5 and the number of rotations of image carrier 5 while cleaning unit 71 is kept in contact with image carrier 5. Storage unit 62 transmits to calculation unit 63 the output value of the strain transmitted from amplifier 61.

Calculation unit 63 calculates the average of latest output values of the strain measured at multiple locations on image carrier 5. Calculation unit 63 compares the average value with an output value of the strain at the time when blade unit 70 reaches the end of its lifetime (referred to as second threshold value, hereinafter). When calculation unit 63 determines that the result of detection (output value of the strain) by strain gauge 76 reaches the second threshold value, based on the result of the comparison, calculation unit 63 determines that the lifetime of cleaning apparatus 1 (blade unit 70) expires.

In this way, the end of time lifetime of cleaning apparatus 1 can be detected accurately. Accordingly, the number of times blade unit 70 is replaced can be reduced. Accordingly, the cost of image forming apparatus 100 can be reduced and a high productivity can be ensured.

Calculation unit 63 transmits to determination unit 64 the fact that blade unit 70 has reached the end of its lifetime. Based on received data, determination unit 64 performs various operations. For example, determination unit 64 instructs display 65 to indicate the fact that blade unit 70 has reached the end of its lifetime.

Figure 7:
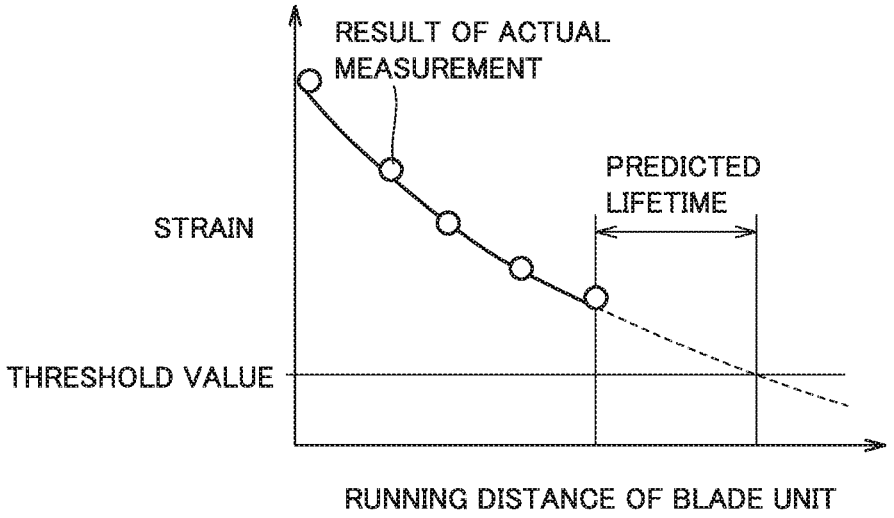
FIG. 7 shows an example relation of the output value of strain to the running distance of the blade unit.

FIG. 7 shows an example relation between the output value of strain and the running distance of blade unit 70. The horizontal shaft represents the running distance of blade unit 70, and the vertical shaft represents the output value of strain of leaf spring 72.

Calculation unit 63 can determine the lifetime of cleaning apparatus 1, and can also predict the lifetime of cleaning apparatus 1 from the running distance of blade unit 70 and the result of detection by strain gauge 76.

Calculation unit 63 can perform regression (regression equation is preferably multiple regression equation) on the data (running distance and strain value of blade unit 70) in storage unit 62 to determine a regression curve. The regression curve in FIG. 7 is determined based on the results of actual measurement of the amount of strain (hollow dots in FIG. 7). The solid line section of the regression curve in FIG. 7 is a curve determined based on the aforementioned results of actual measurement. The dotted line section of the regression curve in FIG. 7 is a regression curve determined through prediction based on the aforementioned results of actual measurement.

During an initial stage of rotation of image carrier 5, variation of permanent strain is large and has a large influence on the regression equation. It is therefore preferable to calculate the regression without using measurements during the initial stage of rotation of image carrier 5.

Calculation unit 63 predicts the running distance for which blade unit 70 will run up to the end of lifetime of cleaning apparatus 1, based on the regression curve and a second threshold value determined experimentally in advance, and transmits the predicted running distance to determination unit 64. Determination unit 64 converts, as required, the running distance of blade unit 70 up to the end of lifetime, into the period of time or the number of sheets up to the end of lifetime, and causes display 65 to show the converted running distance.

Controller 60 predicts the lifetime of cleaning apparatus 1 (blade unit 70) from the running distance of blade unit 70 and the result of detection by strain gauge 76, A blade unit 70 for replacement can thus be prepared at an appropriate timing. Further, blade unit 70 can be replaced immediately before the end of the lifetime of blade unit 70, and therefore, the number of times blade unit 70 is replaced can be reduced.

Formation of Toner Band

As shown in FIG. 6, a stationary layer M in which scraped developer or the like is accumulated is formed upstream, in rotational direction DR1, of the portion where cleaning unit 71 is in contact with image carrier 5. Since stationary layer M is formed, the developer or the like in stationary layer M is supplied between cleaning unit 71 and the surface of image carrier 5 as image carrier 5 is rotated, which reduces the friction between cleaning unit 71 and image carrier 5.

In the case where an original document having a low coverage (ratio of black to white on the original image) is printed repeatedly for a long period of time, the amount of developer scraped from the surface of image carrier 5 is small, and stationary layer M will disappear some time later. The disappearance of stationary layer M affects the cleaning capability and the lifetime of blade unit 70.

In image forming apparatus 100 in the first embodiment, a change of the frictional force between image carrier 5 and cleaning unit 71 due to disappearance of stationary layer M can be detected as the degree of strain of leaf spring 72 by strain gauge 76.

Determination unit 64 controls image forming unit 50 (developing device 4) to cause image forming unit 50 to supply a developer to image carrier 5 when the result of detection by strain gauge 76 reaches a first threshold value (output value of strain when the frictional force between image carrier 5 and cleaning unit 71 becomes a predetermined value or more). Determination unit 64 controls developing device 4 to cause developing device 4 to form a toner band (toner for forming stationary layer M extending in axial direction DR2) on the surface of image carrier 5. As cleaning unit 71 scrapes the toner band, stationary layer M is formed again. In this way, excessive formation of the toner band is avoided, and the consumption of toner can be reduced.

In addition to the first threshold value, several threshold values at different levels can be provided and developing device 4 can be controlled to cause developing device 4 to form toner bands that are different in length or density for example depending on respective threshold values.

In the case where image forming apparatus 100 does not have the capability of predicting the lifetime of blade unit 70 but only has the capability of forming a toner band, storage unit 62 is unnecessary. In this case, the manufacturing cost can be reduced.

In the case of image forming apparatus 100 for industrial use, for example, one job may take a long time, which may require large intervals at which the strain data is acquired. In this case, the strain is detected while image carrier 5 is driven. The strain can be detected stably by forming the above-described toner band between feeding of a sheet of paper and the following feeding of a sheet of paper and keeping a constant frictional force between image carrier 5 and cleaning unit 71.

Functions and Effects

Metal leaf spring 72 is used under a stress in a range that causes elastic deformation of leaf spring 72. Accordingly, factors of variation can be eliminated at the time strain is detected, due to permanent strain (deterioration) in a flexible portion, which is a problem of the conventional rubber blade, and environmental variation (variation of rubber properties due to heat), for example.

As shown in FIG. 3, strain gauge 76 is located away from first joint region 78 toward second end 72*b*, and therefore, strain of leaf spring 72 can be detected without influence of the second moment of area of cleaning unit 71.

Further, strain gauge 76 is located away from second joint region 79 toward first end 72*a*, and therefore, strain gauge 76 can detect strain of leaf spring 72 without considering the region (e in FIG. 3) where no strain is generated in leaf spring 72.

As seen from the above, because strain gauge 76 is disposed between first joint region 78 and second joint region 79, the value of strain detected by strain gauge 76 is large. Thus, the strain output value from strain gauge 76 is large, and strain gauge 76 can detect the strain with high accuracy.

Further, because strain gauge 76 is disposed at a position closer to second joint region 79 than to first joint region 78, it can detect the strain at a position where the strain of leaf spring 72 is large. Thus, the accuracy with which strain of leaf spring 72 is detected by strain gauge 76 can be improved.

Strain gauge 76 is disposed in proximity to second joint region 79, and can therefore detect the strain near a location where a maximum strain is generated. Accordingly, the strain of leaf spring 72 can be detected with higher accuracy.

Cleaning unit 71 and holding member 73 are joined to first surface 72*c*, and leaf spring 72 is joined to holding member 73 with gap 94 formed between leaf spring 72 and holding member 73. Joint end 79*a* is located away from first end 73*b*. Accordingly, free length L1of leaf spring 72 can be set long. The strain can thus be detected at a location where the strain is large (the output value of the strain in the first embodiment is L1/L2 times as large as that for blade unit 70 in a second embodiment described later herein, where L2 is the free length of leaf spring 72 in the second embodiment (see FIG. 8)). Further, blade unit 70 can be downsized while the strain detection accuracy is kept high.

As shown in FIG. 4, at the position where second joint region 79 is located, leaf spring 72 has a length (b2 in FIG. 4) in axial direction DR2 shorter than the length (b1 in FIG. 4) of leaf spring 72 in axial direction DR2 at the position where first joint region 78 is located.

The length of leaf spring 72 in axial direction DR2 can be made shorter to reduce the second moment of area in the shorter-length portion of leaf spring 72. The stiffness of leaf spring 72 can thus be reduced partially, and the strain of leaf spring 72 can be increased partially. Accordingly, the accuracy of detection by strain gauge 76 can be improved.

At the position where second joint region 79 is located, leaf spring 72 has notches 82 at respective opposite ends of leaf spring 72 in axial direction DR2. Accordingly, the strain of leaf spring 72 can be increased partially.

Preferably, at the position where joint end 79*a* with the maximum strain of leaf spring 72 is located, notches 82 are formed, and strain gauge 76 is attached in proximity to joint end 79*a*. Accordingly, the accuracy of detection by strain gauge 76 can further be improved.

Second Embodiment

Figure 8:
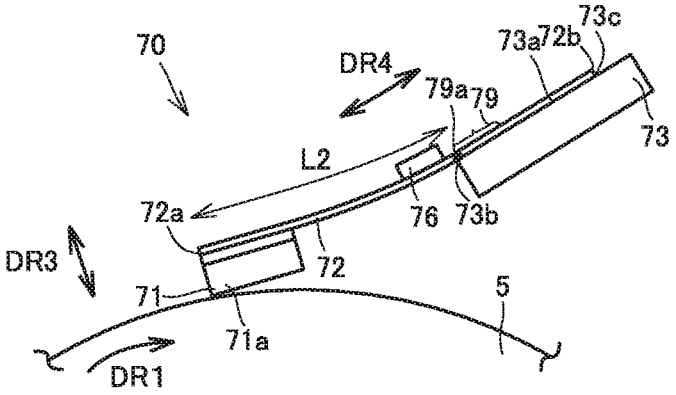
FIG. 8 is a schematic diagram of a blade unit in a second embodiment.

FIG. 8 is a schematic diagram of blade unit 70 in the second embodiment. Unlike the first embodiment, leaf spring 72 in the second embodiment is joined to at least first end 73*b* of facing surface 73*a*. Joint end 79*a* (solid black dot in FIG. 8) is located at first end 73*b*. No gap 94 is formed between leaf spring 72 and holding member 73. In the case where leaf spring 72 is fixed at least at first end 73*b*, spot welding or screwing is difficult for fixing leaf spring 72, and therefore, leaf spring 72 is fixed with an adhesive or double-sided adhesive tape, for example.

Figure 9:
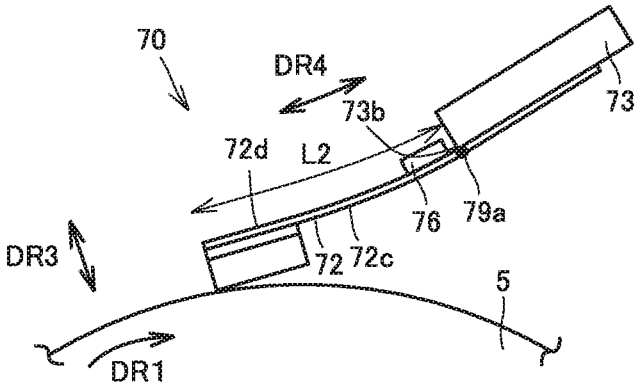
FIG. 9 shows a modification of the blade unit in the second embodiment.

FIG. 9 shows a modification of blade unit 70 in the second embodiment. Unlike holding member 73 in FIG. 8, holding member 73 is disposed to face second surface 72*d* and joined to second surface 72*d*.

In the second embodiment (both FIGS. 8 and 9), the output value of the strain at first end 73*b* is the maximum value. In view of this, strain gauge 76 is disposed in proximity to first end 73*b* to thereby improve the accuracy of strain detection by strain gauge 76.

Third Embodiment

Figure 10:
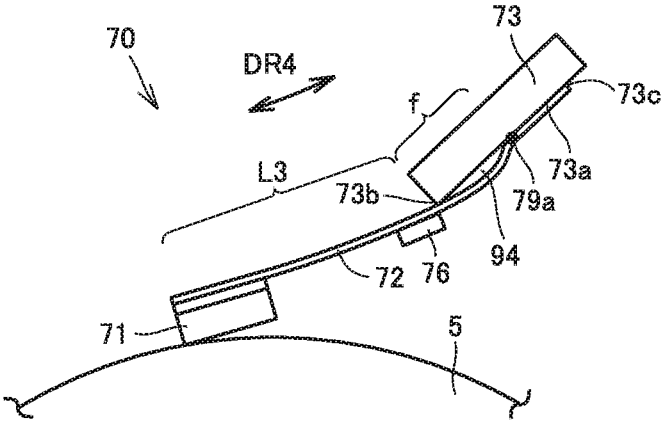
FIG. 10 is a schematic diagram of a blade unit in a third embodiment.

FIG. 10 is a schematic diagram of blade unit 70 in a third embodiment. Unlike the modification of blade unit 70 in the second embodiment (see FIG. 9), leaf spring 72 is not joined to first end 73*b*. Like the first embodiment, leaf spring 72 is joined to facing surface 73*a* at a position closer to second end 73*c* than to first end 73*b*, and gap 94 is formed between holding member 73 and leaf spring 72.

Length L3 in shorter-dimension direction DR4 from first end 72*a* of leaf spring 72 to first end 73*b* of facing surface 73*a* is a parameter determining the contact pressure between cleaning unit 71 and image carrier 5, in addition to the thickness of leaf spring 72, the longitudinal elastic modulus of leaf spring 72, and the amount of bite, for example.

The length (f in FIG. 10) of gap 94 in shorter-dimension direction DR4 influences the contact pressure. Preferably, the ratio between length f and length L3 is determined to satisfy $1/10 \leq f/L3 \leq 1/3$.

Figure 11:
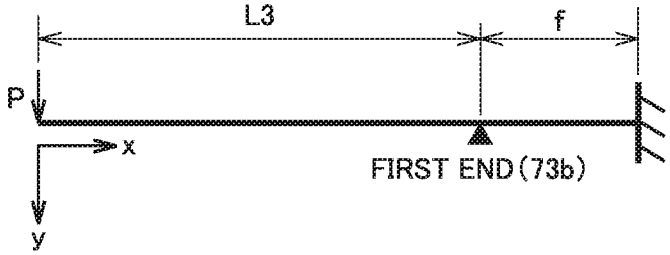
FIG. 11 is a schematic diagram of the blade unit shown in FIG. 10 approximated to a beam.

FIG. 11 is a schematic diagram of blade unit 70 shown in FIG. 10 approximated to a beam. Regarding blade unit 70 in the third embodiment, when cleaning unit 71 is brought into contact with image carrier 5, leaf spring 72 is flexed with first end 73*b* acting as a fulcrum. In FIG. 11, first end 73*b* is the position of the maximum strain. It is therefore preferable to attach strain gauge 76 in proximity to first end 73*b*.

In the third embodiment, the advantageous effect of improving the detection accuracy of strain gauge 76 can also be achieved, like blade unit 70 in the first embodiment.

Fourth Embodiment

Figure 12:
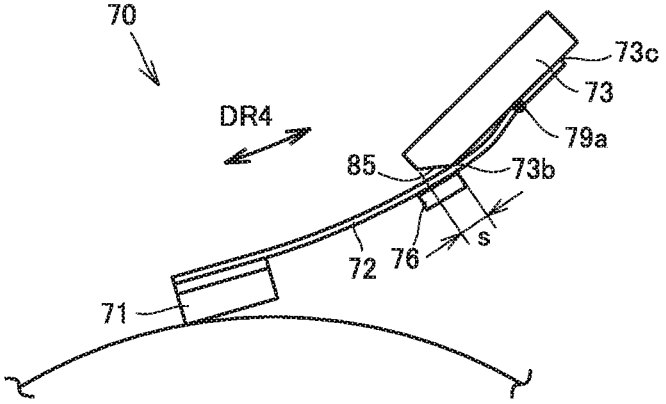
FIG. 12 is a schematic diagram of a blade unit in a fourth embodiment.

FIG. 12 is a schematic diagram of blade unit 70 in a fourth embodiment. Unlike the third embodiment, a beveled portion 85 is formed at first end 73*b* of holding member 73. Because beveled portion 85 is formed, the position where leaf spring 72 contacts holding member 73 can be shifted toward second end 73*c*, as compared with blade unit 70 in the third embodiment. The beveled portion can be formed by surface embossing, milling, or the like. The shape of the beveled portion may be any as long as leaf spring 72 and holding member 73 do not interfere with each other in the region (s in FIG. 12) between first end 73*b* and the end of holding member 73 located relatively closer to cleaning unit 71 in shorter-dimension direction DR4.

Regarding blade unit 70 in the third embodiment, a method for increasing the detection sensitivity is to increase length L3, which, however, results in an increased size of the whole leaf spring 72. Regarding blade unit 70 in the fourth embodiment, beveled portion 85 is formed at first end 73*b* and strain gauge 76 is disposed in proximity to first end 73*b*. Accordingly, the increase in size of leaf spring 72 can be avoided while the strain output value can be made (L3+s)/L3 times as large as that for blade unit 70 in the third embodiment.

Fifth Embodiment

Figure 13:
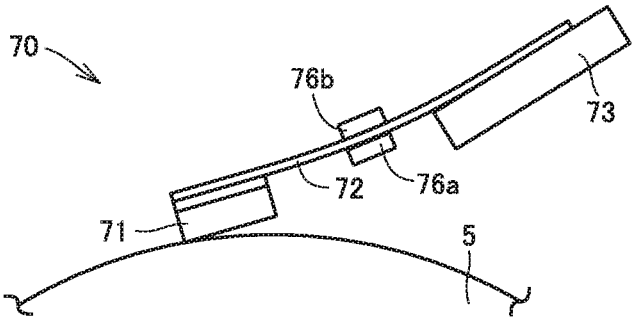
FIG. 13 is a schematic diagram of a blade unit in a fifth embodiment.

FIG. 13 is a schematic diagram of blade unit 70 in a fifth embodiment. Unlike the first embodiment, a plurality of strain detection units are provided. A plurality of strain detection units include a first strain detection unit 76*a* and a second strain detection unit 76*b*. First strain detection unit 76*a* is disposed on first surface 72*c*. Second strain detection unit 76*b* is disposed on second surface 72*d*. Second strain detection unit 76*b* is disposed opposite to first strain detection unit 76*a*.

A plurality of strain detection units can be arranged on leaf spring 72 to improve the detection accuracy of strain of leaf spring 72. In particular, first strain detection unit 76*a* and second strain detection unit 76*b* can be arranged opposite to each other to double the strain output value of the strain detection units.

EXAMPLES

A test was conducted for confirming a difference in strain detection accuracy due to a difference in position where the strain gauge was attached. In an Example, an image forming apparatus (digital printer: bizhub C284e) manufactured by Konica Minolta, Inc. was used, and its image carrier drum unit was modified to enable the blade unit in the first embodiment to be disposed. Test conditions are as follows.

Test Conditions

The elastic portion of the cleaning unit was urethane rubber. The elastic portion had a thickness of 2 [mm], a length in the shorter-dimension direction of 5 [mm], and a length in the axial direction of 340 [mm]. As the material for the leaf spring, SUS304 was used. The leaf spring had a free length of 14 [mm], a thickness of 0.08 [mm], and a length in the axial direction of 340 [mm]. As the material for the holding member, a steel sheet SECC was used. The holding member had a thickness in the thickness direction of 2 [mm] and a length in the axial direction of 340 [mm].

The cleaning unit and the leaf spring were fixed to each other with a hot-melt adhesive applied to the whole range of the cleaning unit. The leaf spring and the holding member were joined to each other by spot welding. The intervals between welding spots (joint spots) in the axial direction were 4 [mm] (see FIG. 4). The distance from one of the opposite endmost welding spots (joint spots) in the axial direction to the corresponding end of the joined portion of the leaf spring in the axial direction, as well as the distance from the other endmost welding spot (joint spot) to the corresponding end of the leaf spring were each 2 [mm].

The contact pressure between the cleaning unit and the image carrier was 30 [N/m], and the effective contact angle θ(the angle formed between the cleaning unit and a tangent at a contact point between the cleaning unit and the image carrier as seen in the axial direction) was 15 [°]. As the image carrier, an organic photoconductor was used. Positions where respective strain gauges were attached to the leaf spring were 7 [mm] (near the center of the leaf spring) and 13 [mm] (in proximity to the joint end) measured from the first end of the leaf spring toward the second end of the leaf spring.

Test Results

Figure 14:
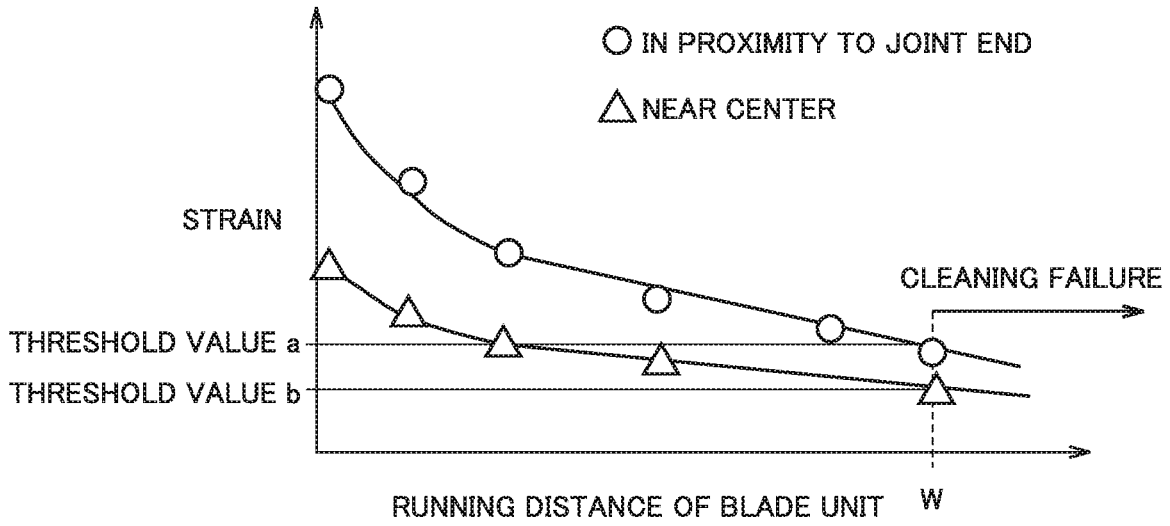
FIG. 14 shows a graph of test results.

FIG. 14 shows a graph of test results. The horizontal shaft represents the running distance of the blade unit, and the vertical shaft represents the output value of the strain gauges. Printing was performed until a cleaning failure occurred on an image, and the running distance and the strain output values during the printing were examined. The running distance at the time the cleaning failure occurred was defined as W and respective strain output values at this time were defined as threshold value a (second threshold value for the strain gauge attached in proximity to the joint end) and threshold value b (second threshold value for the strain gauge attached near the center of the leaf spring).

It is seen from FIG. 14 that at any running distance, the output value of the strain gauge attached in proximity to the joint end (hollow dots in FIG. 14) was about twice as large as the output value of the strain gauge attached near the center of the leaf spring (hollow triangles in FIG. 14).

As to the gradient of the graph, the gradient of the plot for the strain gauge attached in proximity to the joint end was about twice as large as the gradient of the plot for the strain gauge attached near the center of the leaf spring. It was confirmed that for the same running distance, the output value of the former strain gauge was larger. It has thus been established that the position where the strain gauge is attached can be selected appropriately to obtain a larger output value of the strain gauge and detect the strain of the leaf spring with high accuracy.

As described above, a cleaning apparatus in the present disclosure is configured to clean a surface of an image carrier. The cleaning apparatus includes a cleaning unit, a leaf spring, a holding member, and at least one strain detection unit. The cleaning unit is configured to contact the surface of the image carrier. The leaf spring supports the cleaning unit. The holding member holds the leaf spring. The strain detection unit is attached to the leaf spring. The strain detection unit is configured to detect strain of the leaf spring due to deformation of the leaf spring. The leaf spring has a first end and a second end. The leaf spring includes, at the first end, a first joint region to which the cleaning unit is joined and includes, at the second end, a second joint region to which the holding member is joined. The strain detection unit is located between the first joint region and the second joint region.

In the cleaning apparatus, the strain detection unit is disposed at a position closer to the second joint region than to the first joint region.

In the cleaning apparatus, the strain detection unit is disposed in proximity to the second joint region.

In the cleaning apparatus, the holding member includes a facing surface that faces the leaf spring at the second end of the leaf spring, in a thickness direction of the leaf spring. The leaf spring is joined to at least a first end of the facing surface, the first end of the facing surface being located at a side of the cleaning unit.

In the cleaning apparatus, the leaf spring includes a first surface oriented toward the image carrier. The cleaning unit and the holding member are joined to the first surface. The holding member includes a facing surface that faces the first surface at the second end of the leaf spring, in a thickness direction of the leaf spring. The facing surface has a first end located at a side of the cleaning unit and a second end located opposite to the first end of the facing surface. At a position located closer to the second end of the facing surface than to the first end of the facing surface, the leaf spring is joined to the facing surface.

In the cleaning apparatus, the leaf spring includes a first surface oriented toward the image carrier, and a second surface located opposite to the first surface. The cleaning unit is joined to the first surface. The holding member is joined to the second surface. The holding member includes a facing surface that faces the second surface at the second end of the leaf spring, in a thickness direction of the leaf spring. The facing surface has a first end located at a side of the cleaning unit and a second end located opposite to the first end of the facing surface. At a position located closer to the second end of the facing surface than to the first end of the facing surface, the leaf spring is joined to the facing surface.

In the cleaning apparatus, the first end of the facing surface of the holding member has a beveled portion.

In the cleaning apparatus, the image carrier has a rotational shaft. At a position where the second joint region is located, a length of the leaf spring in an axial direction of the rotational shaft is shorter than a length of the leaf spring in the axial direction at a position where the first joint region is located.

In the cleaning apparatus, at the position where the second joint region is located, the leaf spring has notches at respective ends opposite to each other in the axial direction.

In the cleaning apparatus, the at least one strain detection unit is a plurality of strain detection units, In the cleaning apparatus, the leaf spring includes a first surface oriented toward the image carrier, and a second surface located opposite to the first surface. The plurality of strain detection units include a first strain detection unit disposed on the first surface and a second strain detection unit disposed on the second surface and opposite to the first strain detection unit.

An image forming apparatus in the present disclosure includes: a cleaning apparatus according to any of the above-described aspects; a developing device configured to supply a developer to the image carrier; and a controller configured to control the developing device to cause the developing device to supply the developer to the image carrier When a result of detection by the strain detection unit reaches a threshold value.

An image forming apparatus in the present disclosure includes: a cleaning apparatus according to any of the above-described aspects; and a controller configured to determine that a lifetime of the cleaning apparatus expires when a result of detection by the strain detection unit reaches a threshold value.

In the image forming apparatus, the controller is configured to predict the lifetime of the cleaning apparatus from a running distance of the cleaning apparatus and the result of detection by the strain detection unit.

Although embodiments of the present invention have been described and illustrated in detail, the disclosed embodiments are made for purposes of illustration and example only and not limitation. The scope of the present invention should be interpreted by terms of the appended claims.

What is claimed is:

1. A cleaning apparatus for cleaning a surface of an image carrier, the cleaning apparatus comprising:

a cleaning unit configured to contact the surface of the image carrier;

a leaf spring supporting the cleaning unit;

a holding member holding the leaf spring; and at least one strain detection unit attached to the leaf spring and configured to detect strain of the leaf spring due to deformation of the leaf spring, the leaf spring having a first end and a second end, including, at the first end, a first joint region to which the cleaning unit is joined, and including, at the second end, a second joint region to which the holding member is joined, the at least one strain detection unit being disposed between the first joint region and the second joint region.

2. The cleaning apparatus according to claim 1, wherein the strain detection unit is disposed at a position closer to the second joint region than to the first joint region.

3. The cleaning apparatus according to claim 2, wherein the strain detection unit is disposed in proximity to the second joint region.

4. The cleaning apparatus according to claim 1, wherein the holding member includes a facing surface that faces the leaf spring at the second end of the leaf spring, and the leaf spring is joined to at least a first end of the facing surface, the first end of the facing surface being located at a side of the cleaning unit.

5. The cleaning apparatus according to claim 1, wherein the leaf spring includes a first surface oriented toward the image carrier, the cleaning unit and the holding member are joined to the first surface, the holding member includes a facing surface that faces the first surface at the second end of the leaf spring, the facing surface has a first end located at a side of the cleaning unit and a second end located opposite to the first end of the facing surface, and at a position located closer to the second end of the facing surface than to the first end of the facing surface, the leaf spring is joined to the facing surface.

6. The cleaning apparatus according to claim 1, wherein the leaf spring includes a first surface oriented toward the image carrier, and a second surface located opposite to the first surface, the cleaning unit is joined to the first surface, the holding member is joined to the second surface, the holding member includes a facing surface that faces the second surface at the second end of the leaf spring, the facing surface has a first end located at a side of the cleaning unit and a second end located opposite to the first end of the facing surface, at a position located closer to the second end of the facing surface than to the first end of the facing surface, the leaf spring is joined to the facing surface.

7. The cleaning apparatus according to claim 6, wherein the first end of the facing surface of the holding member has a beveled portion.

8. The cleaning apparatus according to claim 1, wherein the image carrier has a rotational shaft, and at a position where the second joint region is located, a length of the leaf spring in an axial direction of the rotational shaft is shorter than a length of the leaf spring in the axial direction at a position where the first joint region is located.

9. The cleaning apparatus according to claim 8, wherein at the position where the second joint region is located, the leaf spring has notches at respective ends opposite to each other in the axial direction.

10. The cleaning apparatus according to claim 1, wherein the at l is one strain detection unit is a plurality of strain detection units.

11. The cleaning apparatus according to claim 10, wherein the leaf spring includes a first surface oriented toward the image carrier, and a second surface located opposite to the first surface, and the plurality of strain detection units include a first strain detection unit disposed on the first surface and a second strain detection unit disposed on the second surface and opposite to the first strain detection unit.

12. An image forming apparatus comprising:

a cleaning apparatus according to claim 1;

a developing device configured to supply a developer to the image carrier; and a controller configured to control the developing device to cause the developing device to supply the developer to the image carrier when a result of detection by the strain detection unit reaches a first threshold value.

13. An image forming apparatus comprising:

a cleaning apparatus according to claim 1; and a controller configured to determine that a lifetime of the cleaning apparatus expires when a result of detection by the strain detection unit reaches a second threshold value.

14. The image forming apparatus according to claim 13, wherein the controller is configured to predict the lifetime of the cleaning apparatus from a running distance of the cleaning apparatus and the result of detection by the strain detection unit.

* * * * *